US006536254B1

(12) United States Patent
Kawalla et al.

(10) Patent No.: US 6,536,254 B1
(45) Date of Patent: Mar. 25, 2003

(54) METHOD AND DEVICE FOR PRODUCING A METAL STRIP FOR TAILORED BLANKS TO BE CUT TO LENGTH

(75) Inventors: Rudolf Kawalla, Bottrop (DE); Friedrich Behr, Krefeld (DE); Hans-Peter Schmitz, Essen (DE)

(73) Assignee: Thyssen Krupp AG, Dusseldorf (DE)

( * ) Notice: Subject to any disclaimer, the term of this patent is extended or adjusted under 35 U.S.C. 154(b) by 0 days.

(21) Appl. No.: 09/787,619

(22) PCT Filed: Sep. 28, 1999

(86) PCT No.: PCT/EP99/07178

§ 371 (c)(1),
(2), (4) Date: Jun. 18, 2001

(87) PCT Pub. No.: WO00/21695

PCT Pub. Date: Apr. 20, 2000

(30) Foreign Application Priority Data

Oct. 12, 1998 (DE) ..... 198 46 900

(51) Int. Cl.[7] ..... B21B 27/06

(52) U.S. Cl. ..... 72/200; 72/201; 72/342.6; 72/342.94; 72/364; 72/365.2

(58) Field of Search ..... 72/200, 201, 202, 72/342.1, 342.2, 342.5, 342.6, 342.94, 342.96, 364, 365.2, 377, 240

(56) References Cited

U.S. PATENT DOCUMENTS

| | | | | | |
|---|---|---|---|---|---|
| 3,896,653 | A | * | 7/1975 | Sakai et al. | 72/200 |
| 4,936,132 | A | * | 6/1990 | Kato et al. | 72/240 |
| 6,035,686 | A | * | 3/2000 | Muhr et al. | 72/240 |
| 6,182,490 | B1 | * | 2/2001 | Ginzburg et al. | 72/200 |
| 6,185,977 | B1 | * | 2/2001 | Schiessl et al. | 72/342.1 |
| 6,336,350 | B1 | * | 1/2002 | Klein | 72/240 |

FOREIGN PATENT DOCUMENTS

| | | | | | |
|---|---|---|---|---|---|
| DE | 83 944 | C | | 11/1895 | |
| DE | 820 287 | C | | 11/1951 | |
| DE | 16 02 197 | A | | 3/1970 | |
| DE | 23 36 459 | A | | 1/1974 | |
| DE | 29 30 005 | A | | 6/1980 | |
| FR | 2 262 726 | A | | 9/1975 | |
| JP | 60 244411 | A | | 12/1985 | |
| JP | 61-172603 | | * | 8/1986 | 72/240 |
| JP | 62-50004 | | * | 3/1987 | 72/200 |
| JP | 63 040604 | A | | 2/1988 | |
| JP | 6-154806 | | * | 6/1994 | 72/240 |
| SU | 940 980 | A | | 7/1982 | |

OTHER PUBLICATIONS

"Flexible Rolled Steel Sheet for . . . ," Schwartz et al., *Werkstatt and Betrieb*, vol. 131, No. 5, May 1, 1998, pp. 424–427.

". . . Beams and Stringers" B. Hachmann et al., Mar. 5, 1992, pp. 4.2–1–4.2–6.

* cited by examiner

*Primary Examiner*—Ed Tolan
(74) *Attorney, Agent, or Firm*—Proskauer Rose LLP

(57) ABSTRACT

The invention relates to a process for the production of tailored blanks by the hot rolling of a strip and to an apparatus for the performance of said process. To obtain tailored blanks to be cut to length from the rolled strip, the hot strip is cooled or heated in portions, so that with a substantially constant rolling force the strip undergoes a differential decrease in thickness in the individual portions, which have been given a differential yield stress value by the differential temperature adjustment.

20 Claims, 4 Drawing Sheets

Figure 1:
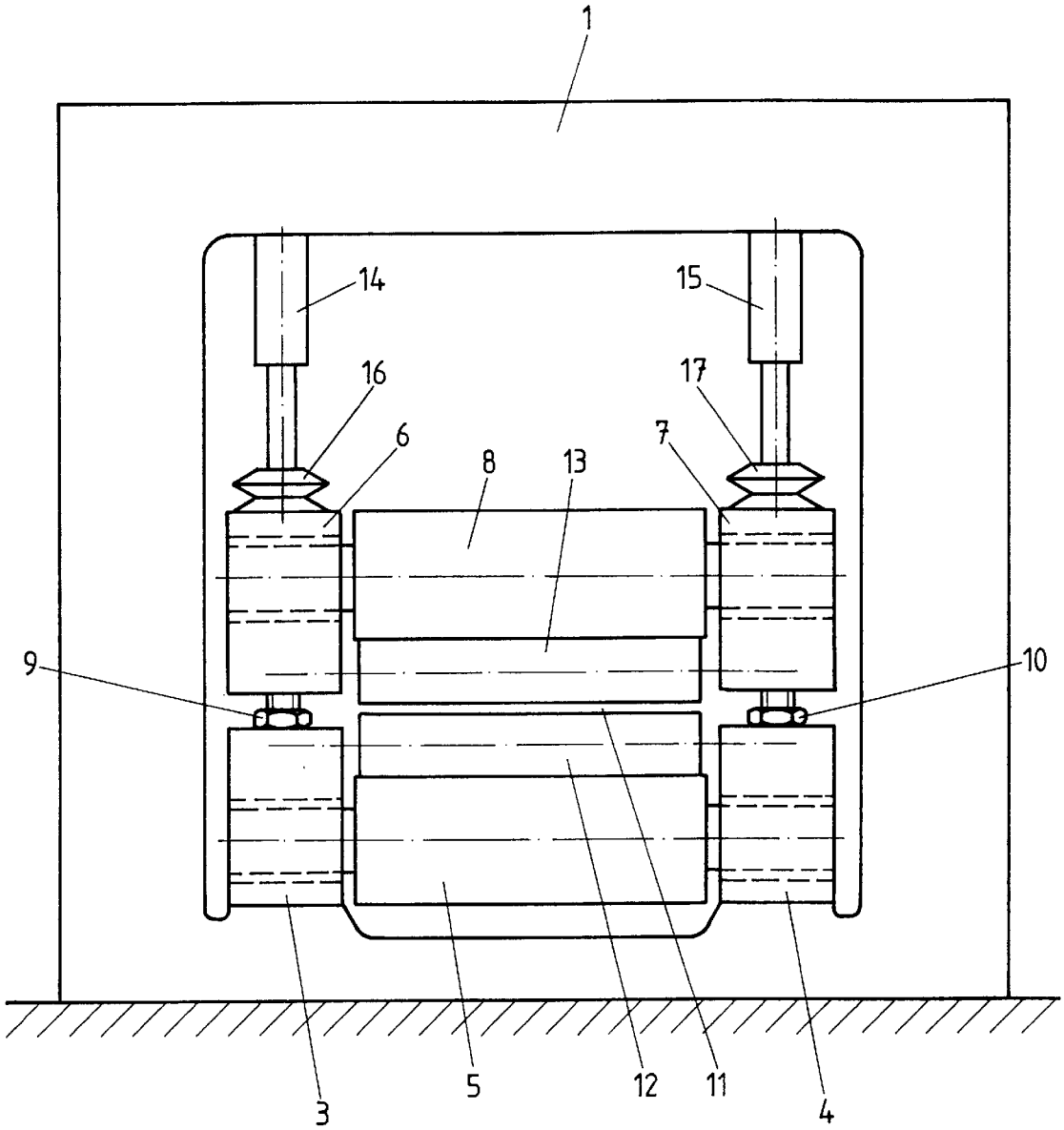

METHOD AND DEVICE FOR PRODUCING A METAL STRIP FOR TAILORED BLANKS TO BE CUT TO LENGTH

This application is a 35 USC 371 of PCT/EP99/07178 filed Sep. 28, 1999.

The invention relates to a process for the production of a more particularly steel metal strip having portions of differential thickness by rolling for tailored blanks to be cut to length.

To use material economically and dimension structural members in dependence on loading, for a fair number of years structural members have been used which have a differential thickness and/or material composition over their surface and/or length ("Umformtechnik"=Shaping Technology, 7th Aachen Steel Colloquium of Mar. 26–27, 1992, "4.2 Rolling of loading-optimised longitudinal sections" by B. Hachmann, R. Kopp, Aachen). The rough products of such structural members are known as tailored blanks. In practice basically two different manufacturing procedures are used for the production of tailored blanks.

In a first production process, widely adopted in practice, a start is made from two sheets of different thickness and/or different material composition which are butt welded to one another. The advantage of such a production process is that inexpensive technical equipment is needed for its performance. However, since the welding process will not permit high production speeds this kind of production is suitable only for making s mall numbers of t h e product. Another disadvantage is that at the weld seam there are abrupt transitions from one sheet to another. The result is that strong and abrupt increases in stress occur under loading. Tailored blanks having optimum loading-dependent dimensions over their whole surface cannot therefore be obtained by such a process.

In another prior art process, not yet significantly adopted in practice, a strip is cold rolled in portions with different roll nips. Such a process is known as "flexible rolling" ("Flexibly rolled sheets for loading-adapted workpieces" by Schwarz, Kopp, Ebert and Hauger in the Journal "Werkstatt und Betrieb"="Workplace and Factory" 131 (1998) 5). In contrast with the first-mentioned process, this process enables gentle transitions from a thicker band portion to a thinner one and vice versa to be achieved by changing the roll nip. For this reason tailored blanks produced from such a strip can be more satisfactorily loading-optimised than tailored blanks obtained from butt welded sheets of differential thickness. However, one disadvantage of this process is that the reduction of the roll nip calls for extremely high rolling forces. Investigations of an actual rolling problem showed that if the roll nip is adjusted by 1.5 mm, the rolling force must be increased by 23000 kN. With an estimated roll stand rigidity of approximately 6000 kN per mm, the result is a spring travel of 3.8 mm, by which the roll stand expands. A hydraulic adjustment of the roll nip must therefore be able to take up both the 3.8 mm expansion and also the 1.5 mm difference in thickness. This requires a very elaborate technical installation and is therefore also very expensive. Another disadvantage of flexible rolling for the production of tailored blanks to be cut to length is that, due to the extremely high rolling forces, short transitions in thickness of, for example, 20 mm in length can be produced only if the rolling speed is very low. It was discovered that with the aforementioned rolling forces it is possible to achieve adjusting speeds of approximately 10 mm/sec, something which gives an adjusting time of 0.53 sec with the aforementioned adjusting travels. A rolling speed of 40 m/min then gives a ramp-shaped transition from the thicker portion to the thinner portion of approximately 353 mm in length. Such a long ramp is clearly too long for the majority of applications of tailored blanks. Consequently, by this process of flexible rolling it is completely impossible to obtain higher rolling speeds of more than 100 m/min if short transition pieces are required.

In a completely different prior art rolling process (DE-PS 505 468) which relates not to the production of tailored blanks to be cut to length from a strip, but to the production of a smooth strip, the strip is first rolled between rolls, at least one of which has a generated surface corrugated in the peripheral direction. A strip corrugated on one or both sides transversely of the strip longitudinal direction produced in this way is then rolled smooth. The meaning and purpose of corrugated rolling is to roll strips using rollers of relatively small diameter without subsequent roll sagging.

It is an object of the invention to provide a rolling process for tailored blanks to be cut to length from the strip and an apparatus suited to said process; the process/apparatus enable short and gently increasing transitions to be produced between strip portions of differential thickness at high rolling speeds, without the need to use extremely high rolling forces.

This problem is solved in a process of the kind specified by the feature that the portions of the strip of differential thickness are produced by hot rolling, the strip being adjusted in portions to a differential temperature by cooling or heating prior to the hot rolling pass. The apparatus according to the invention suited to the performance of the process is characterised by a rolling mill having hydraulic adjustment means which can be adjusted to a constant rolling force, and a strip cooling or heating device disposed upstream of the rolling mill.

The invention makes use of the physical property of a metal strip that its yield stress depends on temperature. The controlled raising or lowering of strip temperature in certain portions thereof produces portions of differential thickness with a substantially constant rolling force. The temperature level of the strip at which rolling is performed is in any case so high that the strip can be rolled with a rolling force substantially reduced in comparison with cold rolling. The reduced rolling force then also makes possible short transitions from portions of thicker strip to portions of thinner strip and vice versa. Since the rolling forces as a whole are comparatively low, another result is substantially lower values for the upward springing of the roll stand, so that there is also no need for correspondingly expensive compensating devices. Whether the strip to be rolled is either heated or cooled to reduce the yield stress of the metal depends on a number of parameters, more particularly the temperature of the metal strip and its quality, rolling conditions and the grain size of the metal strip to be rolled. Preferably the cooling/heating of the metal strip is performed in a temperature range having as high a temperature-dependent yield stress gradient as possible, since small changes in temperature, which can therefore be achieved with a short treatment time, lead to relatively large changes in the yield stress and therefore also to relatively large changes in strip thickness. In individual cases it is possible to depart from this principle, namely if the level of yield stress is substantially lower with a somewhat lower yield stress gradient. In many steels of both steel qualities the largest possible temperature-dependent yield stress gradient lies between the $\alpha$ and $\gamma$ ranges. The difference between the higher strength and soft steels is that in the case of the higher strength steels the $\gamma/\alpha$ transformation takes place over a larger interval of temperature than in the case of soft steels. With few exceptions, in the case of higher strength steels the temperature interval for the transformation is $\Delta Ar=Ar_3-Ar_1>150$ K, while the temperature interval for the transformation in the case of soft steels is $\Delta Ar=Ar_3-Ar_1<130$ K. Alongside this or in addition higher strength and soft steels can also be distinguished by means of the carbon equivalent according to Yurioka (Australian Weld. Res. Ass. Melbourne Mar. 19,20, 1981, Paper 10, pp. 1–18) using the following the formula:

$$CEN=C+[0.75+0.25*\tan h(20+(C-0.12))]*\{Si/24+Mn/6+Cu/15+Ni/20+(Cr+Mo+V+Nb+Ti)/5+5*B\}$$

wherein the alloying contents must be allowed for in percent by weight. The limit value CEN for soft and higher strength steels is CEN=0.1. Higher strength steels lie above this limit value, while soft steels lie therebelow. Lastly, it is also characteristic of hard steel qualities that as a rule they have a carbon content of >0.0.5 percent by weight, while such content is lower in the case of soft steels.

Due to the aforedescribed differential temperature-dependent yield stress gradient, in the case of soft steels the strip should be rolled in both the austenite and the ferrite zones, namely the band portions thicker after rolling in the austenite zone with the higher temperature, and the cooled strip portions thinner after rolling in the ferrite zone. This differential manner of treatment in the case of soft steels is the result of the course of yield stress, with local minimum and maximum with increasing temperature between the ferrite and austenite zones. The result of this special course of yield stress in the case of soft steels is that there is a smaller strip thickness in the portions cooled prior to hot rolling than in the uncooled portions. With soft steels it is preferred to perform rolling exclusively in the austenite and/or ferrite zone, and not in the transitional zone ($\alpha+\gamma$). In the case of higher strength steels with sluggish transformation behaviour and relatively small yield stress gradients in the $\gamma/\alpha$ zone, use can also be made of the biphase zone ($\gamma+\alpha$), since no abrupt transformation of structure or changing yield stress occurs with slight changes of temperature. In the case of such steel qualities the starting point of the cooling of the metal strip should lie in the biphase zone and the end point of the heating of the metal strip in the biphase zone. At the same time, the hot rolling is preferably performed in the biphase zone ($\gamma+\alpha$) in those portions of the metal strip whose thickness is to be reduced, and in the ferrite zone ($\alpha$) in the other portions.

Basically the strip is rolled with a substantially constantly rolling force. However, if provision is made for changing the rolling force, influence can additionally be exerted on the degree of thickness reduction. This is advantageous if the required thickness reduction cannot be achieved solely via a change in temperature. In the hot rolling pass the thickness reduction of the metal strip should also be at least 10% also in the thicker portions.

Suitable materials for the performance of the process are hot strip reheated from the cold state; hot strip maintained at a predetermined temperature in the coil; and hot strip obtained directly from the heat of the melt by a double roller and supplied by the double roller directly to the production process according to the invention. Although after hot rolling the shaping properties of the strip are not as different in the portions of reduced thickness as in a cold rolled strip with strengthening by cold working, after hot rolling the strip can be given a heat treatment to even out the different shaping properties. Thus, the cooled metal strip can be heated to a temperature of more than 600° C. However, the strip is preferably maintained at a temperature of over 600° C. For temperature maintenance use can be made of the temperature which the strip has after hot rolling. This is advantageously done in the coil. However, a heat treatment can also be performed in an annealing furnace or in hot galvanisation using a temperature of above 600° C.

In contrast, if the different material properties obtained by hot rolling are to be maintained in the individual portions, the metal strip can after the rolling pass be uniformly cooled to a temperature ≦500° C.

To change over the roll nip from thinner band portions to thicker band portions and vice versa without heavy expenditure for technical apparatus, in one embodiment of the invention the constant rolling force is transmitted from the hydraulic adjusting means via a spring assembly to the rolling mill. In that case the springs act after the fashion of force/energy accumulators which react rapidly to the changing resistance to deformation of the strip, without the need to activate the hydraulic adjusting means.

To give the strip differential flow stress in portions via its temperature, use can be made of heating devices, such as inductive heating devices, and also cooling devices. The simplest means of effecting this is that the strip cooling device has nozzles which are directed at the strip surface and operated with compressed air, water or steam. Since the time during which the nozzles act on the strip is one of the decisive factors for the degree of cooling, their action time can be influenced in the direction of lengthening with a high strip speed via the feature that the nozzles can be pivoted or rotated in the direction in which the strip runs. Another possibility is that the nozzle arrangement is entrained parallel with the strip at the same speed.

To ensure that the minimum strip thickness is not exceeded, according to the invention the rolling mill can be adjusted to a given minimum roll nip.

Figure 2:
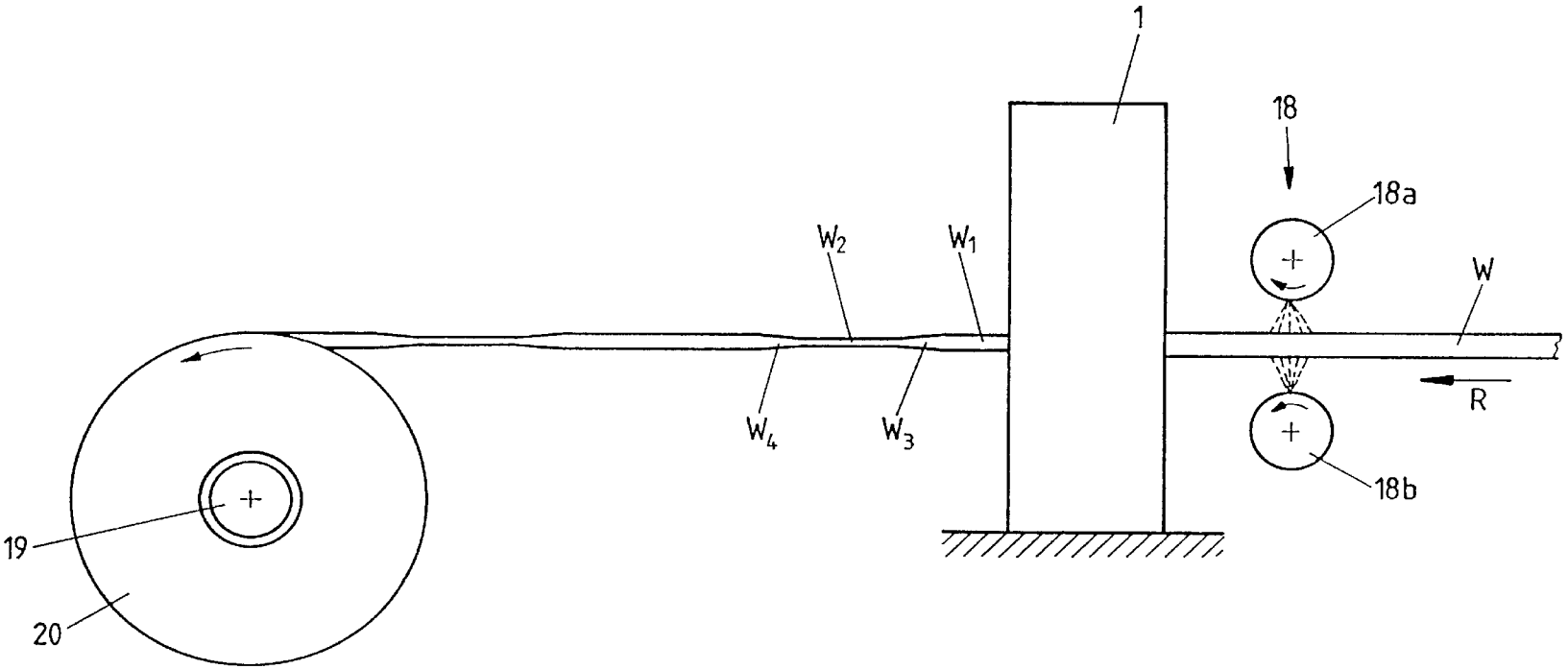
Figure 3:
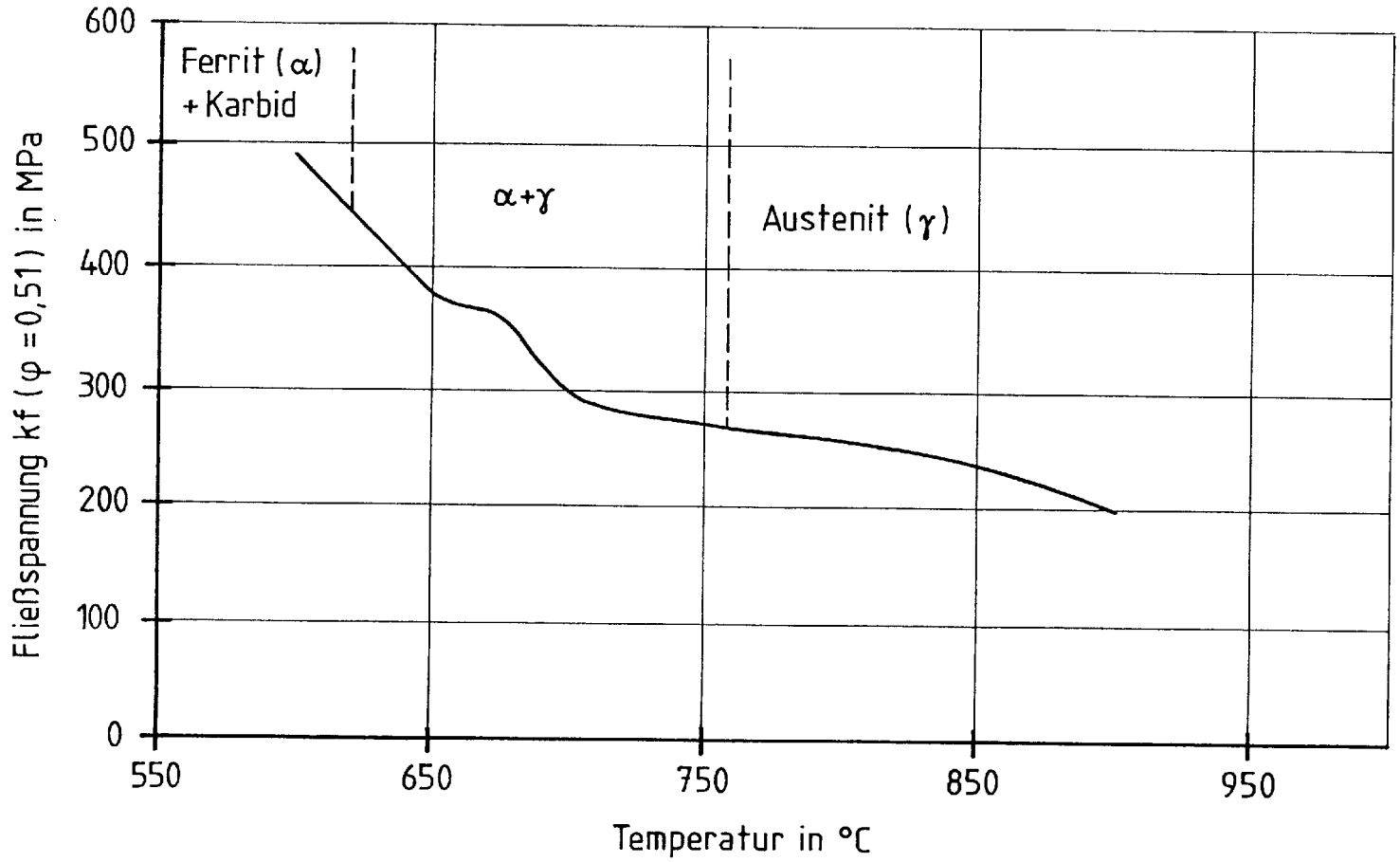
Figure 4:
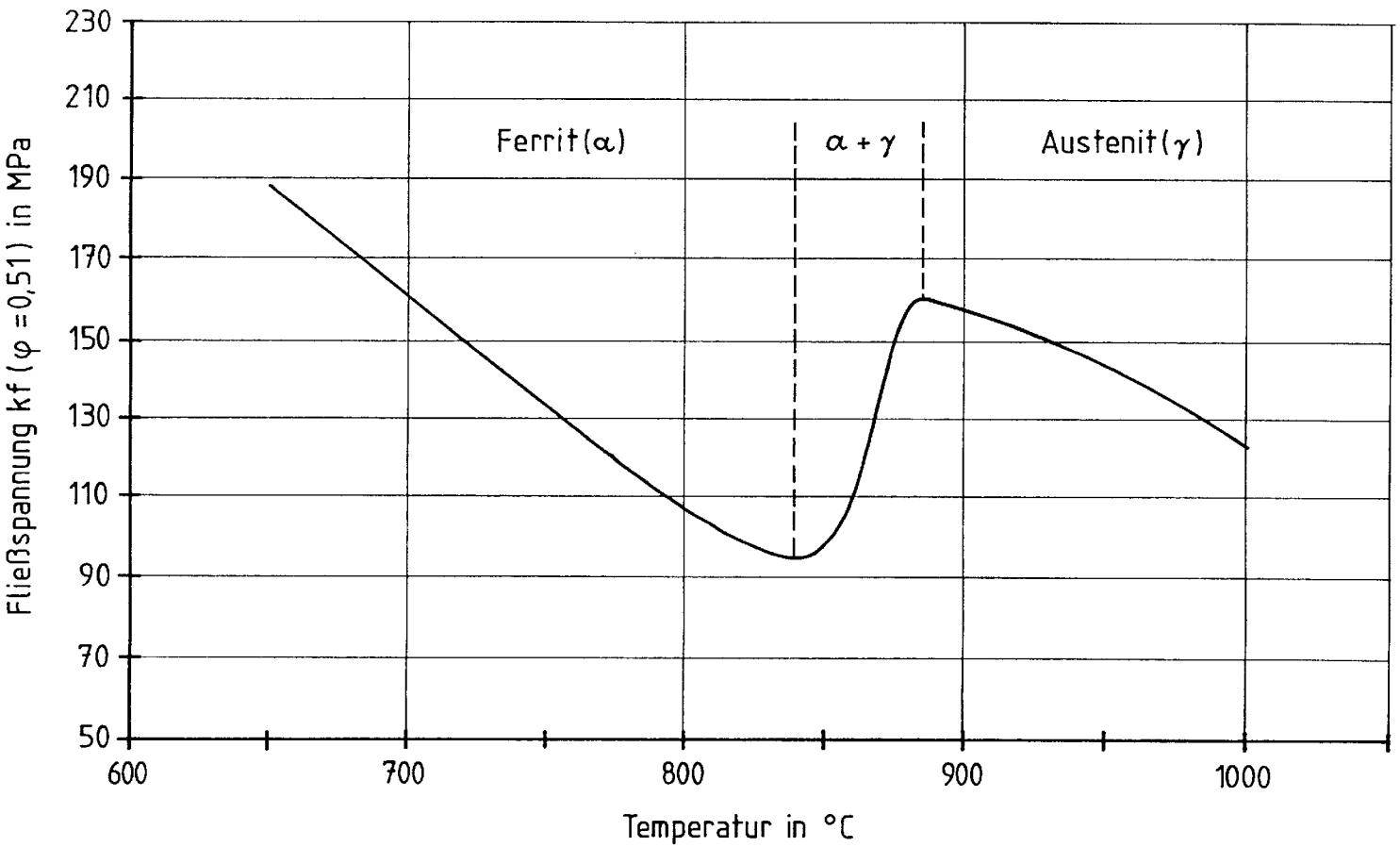

The invention will now be explained in greater detail with reference to drawings which show:

FIG. 1 a front elevation of a roll stand,

FIG. 2 a side elevation of the roll stand shown in FIG. 1 with cooling device and a coiling reel, FIG. 3 A temperature-dependent yield stress graph for a higher strength steel, and FIG. 4 A temperature-dependent yield stress graph for a soft steel.

A roll stand as illustrated consists of a frame 1 in which two lower bearing blocks 3, 4 for a lower support roll 5 are disposed fixed. Two upper bearing blocks 6, 7 bear an upper support roll 8. Associated with the bearing blocks 6, 7 are two adjusting devices 9, 10 for a minimum roll nip 11, which is situated between two working rolls 12, 13 bearing against the support rolls 5, 8.

The upper bearing blocks 6, 7 are adjusted by hydraulic adjusting means 14, 15. Spring assemblies 16, 17 are disposed as force and energy accumulators between the hydraulic adjusting means 14, 15 and the upper bearing blocks 6, 7.

As FIG. 2 shows, associated with such a roll stand in the direction R in which a hot strip W runs through is a cooling device 18 consisting of pivotable or rotating cooling nozzles 18*a*, 18*b* which are disposed above and below the hot strip W and are directed thereagainst. The cooling nozzles 18*a*, 18*b* are preferably operated with steam. This is done at intervals, to cool the hot strip W in portions. Cooling is so performed that with an adjusted, substantially constant rolling force the hot strip W entering the roll stand leaves the roll stand with alternatively thick and thin portions $W_1$, $W_2$ and ramp-shaped short transitions $W_3$, $W_4$. To make the drawing clearer, these relationships are shown exaggerated in size.

The yield stress graphs for a high strength steel quality (FIG. 3) and for a soft steel quality (FIG. 4) follow a completely different course. This different course must be allowed for when adjusting the strip temperature to be adjusted differentially in portions. In the case of soft steels (FIG. 4) the temperature should be so adjusted that rolling is performed only outside the mixed zone ($\alpha+\gamma$). In dependence on whether the hot strip W is supplied to the rolling mill at a temperature in the austenite or ferrite zone, the strip is either cooled or heated. Preferably the change in temperature of the hot strip is induced in a zone of the yield stress/temperature curve in which the gradient of the curve is maximum—i.e., in a zone in which the greatest possible changes in yield stress can be achieved with the lowest possible change of temperature. The fact must also be allowed for that the hot rolling pass preferably should be performed at as high a temperature level as possible, so that the rolling force required remains as low as possible.

If a start is made from a high strength steel quality (FIG. 3) and the strip is supplied to the rolling mill at a temperature in the biphase zone, prior to the rolling pass the strip is cooled down to a temperature in the ferrite zone by the cooling device 18 over the whole portion in which the strip is to have the greater thickness after the rolling pass. The uncooled strip portion then experiences a heavier reduction in thickness. However, all the strip portions should experience a reduction in thickness by at least 10% in the rolling mill. In contrast, in the case of a soft steel quality (FIG. 4) that strip portion which is to be the thinnest at the exit from the rolling mill is cooled by the cooling device 18 down to a temperature in the ferrite zone. Due to the particular course of the yield stress curve with a temperature-conditioned steep drop in the yield stress, the portion to be cooled need be cooled by only a comparatively small amount.

In this case also the reduction of thickness in the portions thicker following rolling should be at least 10%.

The resulting strip, with thin and thick portions $W_1$, $W_2$ and ramp-shaped short transitions $W_3$, $W_4$ leaves the rolling mill with a temperature of just 600° C. in the one case and slightly above 800° C. in the other. Use can be made of this rolling heat to give the strip a heat treatment. The embodiment illustrated in FIG. 2 indicates how the strip is wound by a winding device 19 into a coil 20. At the same time the temperatures of the strip portions at different temperatures are evened out. An evening-out also takes place in the differential material properties arising during rolling in the portions rolled to a varying degree.

Finally, the tailored blanks are obtained by cutting to length from such a strip.

(Wording on Drawings)

FIG. 3: ordinate=temperature in ° C.; abscissa=yield strength Kf($\Phi$=0.51) in Mpa wording: A=ferrite ($\alpha$)+carbide; B=austenite ($\gamma$)

FIG. 4: ordinate and abscissa as in FIG. 3 wording: A=ferrite ($\alpha$): B=austenite ($\gamma$)

What is claimed is:

1. A method to transform a metal strip into tailored blanks by rolling, at least one rolling being a hot roll pass and the metal strip having portions of different thickness in longitudinal direction, the method comprising:

adjusting the portions of the metal strip to different temperatures by cooling or heating said portions prior to the hot rolling pass of said metal strip, thereby producing the portions of different thickness; and;

subjecting the portions of different thickness to a constant rolling force.

2. A process according to claim 1, wherein depending on steel quality (soft or higher strength) and on the temperature of the metal strip, the metal strip is either heated or cooled in portions, to reduce the yield stress of the steel.

3. A process according to claim 1, wherein in the case of higher strength steel qualities, in which a biphase zone ($\gamma+\alpha$) extends over a larger temperature range, the starting point of the cooling of the metal strip lies in the biphase zone ($\gamma+\alpha$) and the end point of the heating of the metal strip lies in the biphase zone ($\gamma+\alpha$).

4. A process according to claim 3, wherein hot rolling is performed in the biphase zone ($\gamma+\alpha$) in those portions of the metal strips whose thickness is to be reduced, and in the ferrite zone ($\alpha$) in the other portions.

5. A process according to claim 2, wherein in the case of soft steel qualities hot rolling is performed in the ferrite zone ($\alpha$) in those portions whose thickness is to be reduced and in the austenite zone ($\gamma$) in the other portions.

6. A process according to claim 1, wherein the cooling or heating of the metal strip is performed in a temperature range having as high a temperature-dependent yield stress gradient as possible.

7. A process according to claim 1, wherein during hot rolling the thickness of the thicker portions of the metal strip is reduced by at least 10%.

8. A process according to claim 1, wherein hot rolling is performed with a substantially identical rolling force in the thin and thick portions.

9. A process according to claim 1, wherein after hot rolling the metal strip is given a heat treatment, to even out the differential shaping properties obtained in portions during hot rolling.

10. A process according to claim 9, wherein after hot rolling the temperature of the metal strip is maintained at T>600° C.

11. A process according to claim 10, wherein the temperature is maintained in the coil.

12. A process according to claim 1, wherein immediately following hot rolling the metal strip is cooled to a temperature <500° C.

13. A process according to claim 9, wherein the metal strip is heated to a temperature >600° C.

14. A process according to claim 9, wherein the heat treatment is performed during passage through an annealing furnace or a hot galvanizing installation.

15. An apparatus to transform a metal strip into tailored blanks by rolling, the metal strip having portions of different thickness, the apparatus comprising;

a roll stand with hydraulic adjusting means for the performance of the process according to claim 1, wherein the hydraulic adjustment means is adjustable to a substantially constant rolling force; and a strip cooling or heating device upstream of the rolling mill.

16. An apparatus according to claim 15, wherein the constant rolling force is transmitted from the hydraulic adjusting means to the rolling mill via a spring assembly.

17. An apparatus according to claim 15, wherein the strip cooling device has nozzles which are directed at the strip surface and operated with compressed air, water or steam.

18. An apparatus according to claim 17, wherein the nozzles can be pivoted or rotated in the direction in which the strip runs.

19. An apparatus according to claim 18, wherein in the direction in which the strip runs the nozzles are entrained substantially parallel with the strip at the strip running speed.

20. An apparatus according to claim 15, wherein the rolling mill can be adjusted to a given minimum roll nip.

* * * * *

UNITED STATES PATENT AND TRADEMARK OFFICE

CERTIFICATE OF CORRECTION

PATENT NO. : 6,536,254 B1
DATED : March 25, 2003
INVENTOR(S) : Rudolf Kawalla et al.

It is certified that error appears in the above-identified patent and that said Letters Patent is hereby corrected as shown below:

Title page,
Item [73], Assignee, should read -- Thyssen Krupp Stahl AG --

Signed and Sealed this

Twenty-first Day of October, 2003

JAMES E. ROGAN
*Director of the United States Patent and Trademark Office*